United States Patent [19]

Brainard

[11] Patent Number: 4,736,837

[45] Date of Patent: Apr. 12, 1988

[54] DISPLAY BOX HAVING HINGEDLY-CONNECTED SECTIONS

[75] Inventor: Richard Brainard, Beacon Falls, Conn.

[73] Assignee: Dataease International Inc., Trumbull, Conn.

[21] Appl. No.: 50,622

[22] Filed: May 15, 1987

[51] Int. Cl.[4] ..... B65D 25/08; B65D 25/34; B65D 43/16

[52] U.S. Cl. ..... 206/45.11; 206/45.15; 206/425; 206/444; 220/22; 220/259

[58] Field of Search ..... 206/44 B, 44 K, 44 R, 206/44.11, 45.11, 45.13, 45.15, 45.18, 45.2, 45.23, 45.24, 45.28, 425, 444; 211/50; 220/345, 22, 259; 229/9, 11

[56] References Cited

U.S. PATENT DOCUMENTS

| | | | |
|---|---|---|---|
| 36,200 | 8/1862 | Woods | 229/11 |
| 1,102,191 | 6/1914 | Hammond | 229/9 |
| 2,685,882 | 8/1954 | Martin | 206/45.11 |
| 3,592,344 | 7/1971 | Schade | 211/50 |
| 3,908,821 | 9/1975 | Lambert | 206/425 |
| 4,588,074 | 5/1986 | Strong et al. | 206/45.23 |
| 4,630,731 | 12/1986 | Albery | 211/50 |

FOREIGN PATENT DOCUMENTS

| | | | |
|---|---|---|---|
| 1113205 | 3/1956 | France | 206/45.11 |

*Primary Examiner*—Jimmy G. Foster

*Attorney, Agent, or Firm*—Roberts, Spiecens & Cohen

[57] ABSTRACT

A display box is provided for displaying material such as pamphlets, discs, and the like. The box includes hingedly-connected first and second sections adapted for relative pivotal movement between closed and opened conditions. In the closed condition, the sections cooperatively define an enclosed storage space. In the opened condition, the sections respectively define adjacent supplementary receptacles for the accommodation and display of the materials to be displayed. The sections in the closed condition have edges which are in facing and abutting relationship, these edges in opened condition being in extension of one another. The sections in the closed condition have co-planar top faces constituting the top of the box. The top face of the second section moves into co-planar relationship with the bottom face of the second section in the opened condition. The sections furthermore have co-planar front faces which in opened condition move into face-to-face abutting relationship. The second section is provided with a plurality of partitions dividing the space thereof into separate sections. The first section has a cover with an opening therein to accommodate further of the above-mentioned materials.

11 Claims, 1 Drawing Sheet

DISPLAY BOX HAVING HINGEDLY-CONNECTED SECTIONS

FIELD OF INVENTION

This invention relates to storage boxes and the like which are adapted to be converted into display devices and more particularly to display boxes having hingedly-connected sections which are adapted to assume in opened condition a display function in which materials are readily and pleasingly displayed.

BACKGROUND

Display packages and boxes have long been the subject of development as evidenced by U.S. Pat. Nos. 476,765; 623,007; 1,403,869; 1,503,161; 1,930,347; 1,996,232; 4,105,112; 4,368,817; and 4,478,335.

Insofar as it pertains to the instant invention, U.S. Pat. No. 476,765 to G. P. Knapp consists of a box having hingedly-connected sections, the relative opening of which provides for the exhibition of an advertising card and moreover provides for the storage of individual packages. As will be shown hereinafter, the display package conceived by Knapp differs from the instant invention in a number of ways including, but not limited to, the location of the hinging between the sections and the purposes for which the different sections are intended.

W. S. Grange in U.S. Pat. No. 623,007 also reveals a box having a hingedly-connected top section, the purpose of which is quite different from that of the instant invention an which is not suitable to perform the purposes to which embodiments of the present invention may be put.

W. Reid in U.S. Pat. No. 1,403,869 reveals hingedly-connected sections and in particular a display box including a container and an outer telescopic member having its side walls severed and having perforations across the top near one end, whereby the upper portion of the outer member may be swung with respect to the lower portion to receive one end of the container for supporting the container in display condition. As will be seen hereinafter, this is substantially different from the purpose and construction envisaged in relation to the novel concept which has been developed.

In U.S. Pat. No. 1,503,161, G. Hornecker, shows a box having hingedly-connected sections which are intended to provide a simple and inexpensive box for point of display use. The box of this patent is adapted to advertise its contents and at the same time protect the contents against theft. It is also a purpose of the Hornecker invention to provide a construction which can be made from a one-piece blank. As will be shown in greater detail hereinbelow, the embodiments envisaged in accordance with the present invention are substantially different from what is shown in this particular patent.

H. C. Meyer shows in U.S. Pat. No. 1,930,347 a holder for recipe books and the like. While the top portion of the box is hinged in a manner somewhat similar to that of the present invention, the portion which moves hingedly forward from the box is intended to serve as an easel for a selected content of the box itself and the hinged portion swings forward to rest upon a corner in a manner unlike what is contemplated in accordance with the present invention.

J. K. Darragh in U.S. Pat. No. 1,996,232 reveals two hingedly-connected sections which are fashioned in a manner entirely different from that of the present invention. More particularly, this patent shows a slide box having a sleeve cover formed into parts comprising an easel and a band hingedly-connected and a drawer formed in two parts hingedly-connected to permit movement of a part of the drawer into a position overlying the easel when in display position.

J. Graf in U.S. Pat. No. 4,105,112 shows a lockable box with a tray and cover hinged together at the open rear end of the cover and locked at their opposite ends. A pair of detent spring fingers extend upwardly from the end of the tray lock over shoulders within the unhinged end of the cover. Further provisions are made whereby to enable shipping materials back and forth from address to another and to provide a permanent lockable box and address plate which can easily be changed to facilitate shipment in both directions. As will be seen hereinafter, this purpose is quite different from that of the present application.

In U.S. Pat. No. 4,368,817, Louis Temesvary shows a unitary hinged box-type container for enclosing contents such as flexible disk packages including complementary top and bottom portions, connected by an intermediate hinge. The portions mate together to form an enclosed box in closed position and furthermore there is provided an open position locking device for securing the container in open position with the top portion rotated approximately 270° about the hinge from the closed position. As will be seen, this is substantially different from what is contemplated within the scope of the present invention.

Jerry Long et al. reveal in U.S. Pat. No. 4,478,335 a diskette storage container formed of three molded plastic parts which are pivotally connected together. A substantially rectangular base member has upwardly rising side walls, a display operative in the bottom and cams adjacent the side walls. A cover member is pivotally connected to the base so that the rear edge of the cover passes into the base and rests at a slightly obtuse angle against the cams. As will be seen hereinbelow, this type of construction differs markedly from that of the present invention.

SUMMARY OF INVENTION

It is an object of the invention to provide an improved display device and more specifically an improved display box including pivotally connected sections adapted for being converted between opened and closed conditions in which the structure respectively constitutes a display device or a storage device.

It is a further object of the invention to provide an improved display holder for pamphlets, software, computer instructions, disks and the like which serves as a stand which permits page turning.

Yet another object of the invention is to provide an improved structure which is readily manufactured by mass production techniques and which is susceptible of being presented in pleasing form and which is capable of constituting kits relating to the storage and utilization of software instructions.

In achieving the above and other objects of the invention, there is provided a display box for displaying materials, said box comprising hingedly connected first and second sections adapted for relative pivotal motion between closed and open conditions, said sections in said closed condition cooperatively defining an enclosed storage space, said sections in said opened condition respectively defining adjacent supplementary receptacles for the accommodation and display of the aforementioned materials. Furthermore, the sections in the closed condition will preferably have edges which are in facing and abutting relationship, said edges in said open condition being in extension of one another.

As a further feature of the invention, the abovementioned sections have co-planar top faces constituting the top of the box in the closed condition thereof and the first section includes a bottom face constituting the bottom of the box. The top face of the second section moves into co-planar relationship with the bottom face of the first section when the box is in the opened condition. As still a further feature, the sections have, in said closed condition, co-planar front faces which in the opened condition move into face-to-face abutting relationship.

More specifically, the second section defines an inner space and preferably includes at least one interior partition parallel to the front face of the second section and dividing the inner space of the second section. Preferably the second section includes a plurality of graduated partitions including the first mentioned partition.

According to still a further feature of the construction of the invention, the first section defines an inner space and includes a cover partly covering or obturating this space and defining an open receptacle into which at least some of the above-mentioned materials can be inserted. Moreover, the box includes a rear top edge portion at which the sections include inter-engageable male and female portions.

As will appear from the Detailed Description which follows hereinbelow, pamphlets of graduated height may be stored in the aforesaid receptacle. Preferably, the abovementioned cover is of a sloped posture.

In accordance with the invention, there is provided a sleeve-type cover encircling the section in the closed condition of the box to hold the sections in the closed condition. Preferably, the second section has triangular end faces and is of triangular cross-section. Furthermore, the above-mentioned male portion is also a generally triangular cross-section and the second section is preferably of a height which is approximate one-half the height of the box.

The above and other objects, features and advantages of the invention will be found in the Detailed Description which follows hereinbelow as illustrated in the accompanying drawing.

DETAILED DESCRIPTION

Figure 1:
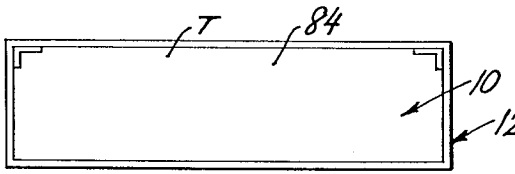
FIG. 1 is a top view of the display box of the invention shown complete with an encircling outer wrap.

The display box of the invention as illustrated in FIG. 1 is indicated at 10. The outer wrap therefor is indicated at 12. The top of the box is indicated at T. It is of generally rectangular conformation as is the cross section of outer wrap 12. The outer wrap 12 may be fabricated of paper or plastic or combinations thereof. Under certain circumstances the wrap may even be fabricated of a metal foil or the like. Generally, the material of the outer wrap 12 will be suitable for carrying printed material in the form of identifying text or advertising material or the like.

Figure 2:
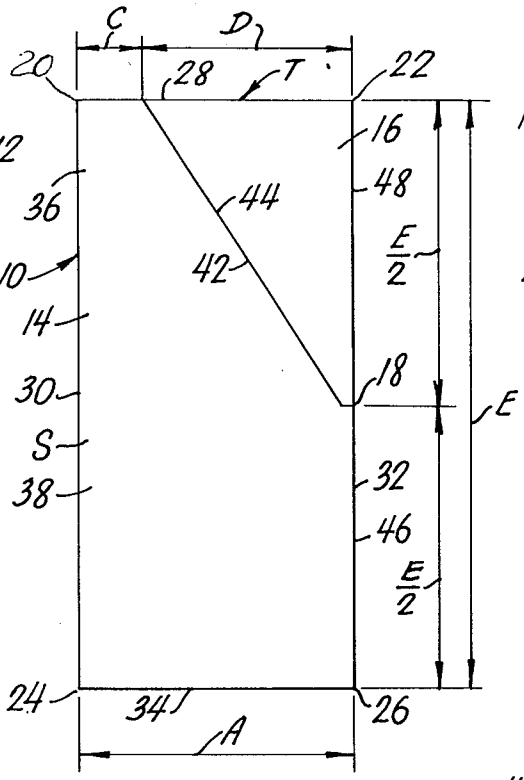
FIG. 2 is a side view of the display box of the invention with the outer wrap removed.

As shown in FIG. 2, the box 10 has a side face S which is generally rectangular in conformation. FIG. 2 also illustrates that the box consists of first and second sections 14 and 16, respectively generally hinged together at 18. The hinged arrangement can result from a material which is susceptible of being folded along a straight line at which the sections are hingedly-connected. As an alternative, metallic hinges or the like may also be employed.

Side face S is duplicated by a complementary face at the other side edge of the box which does not appear in FIG. 2. What is stated herein with respect to side face S is also true of the complementary side face. More particularly, the side face has corners 20, 22, 24 and 26 and edges 28, 30, 32 and 34. The first section 14 consists of a truncated triangular portion 36 at the base of which is a generally rectangular portion 38.

The section 16 has a generally triangular configuration and complements the truncated triangular section 36 so that the two sections together form a rectangle.

Figure 3:
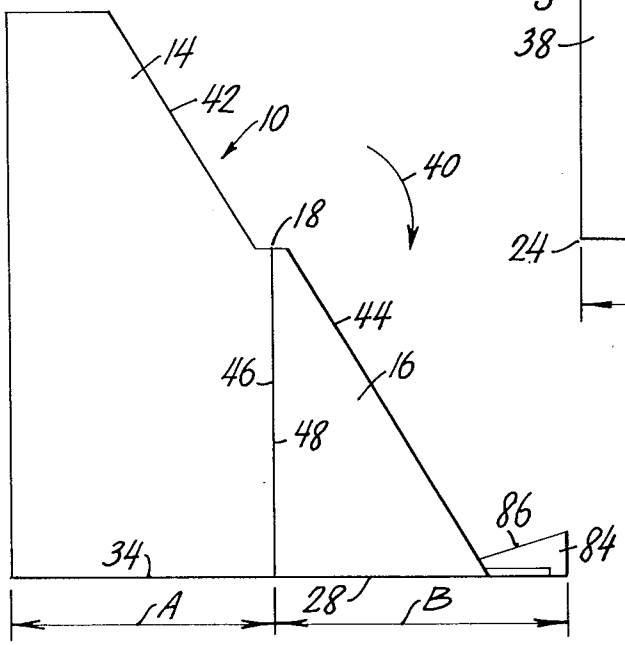
FIG. 3 is a view corresponding to FIG. 2 with the hinged sections of the box having been moved from closed to open condition.

Whereas FIG. 2 illustrates the closed condition of the display box of the invention, FIG. 3 illustrates the opened condition of the box. Herein it is seen that the first section 16 has been pivoted about hinge section 18 in the manner generally indicated by arrow 40. It now appears that the section 14 has a sloped edge 42 whereas the portion 16 has a sloped edge 44. In FIG. 3, these sloped edges are virtually in rectilinear extension of one another, whereas in FIG. 2 these edges may be observed to be in face-to-face abutting relationship.

It will also be seen that the section 14 has a front face 46 with the front face 48 of section 16 coming into face-to-face abutting relationship with the same. In FIG. 2, it will be observed that the front face 46 and the front face 48 are in substantially co-planar relationship with one another thereby to form the planar front face of the box.

It will also be observed with reference to FIG. 2 that the bottom of the box is formed by the bottom edge or face 34 of the first section 14. In FIG. 2, the face or edge 28 of the section 16 is in spaced parallel relationship with the face or edge 34. In FIG. 3, the face or edge 28 moves into at least substantially co-planar relationship with the face or edge 34, thereby to form an extension of the same. It will thus appear from what has been described hereinabove that the sections are adapted for relative pivotal motion between closed and opened conditions. In the closed condition, the sections cooperatively define an enclosed storage space which is located within the box and, in opened condition, the sections respectively define adjacent supplementary receptacles for the accommodation and display of the materials which may have previously been stored in the box and are now susceptible of being appropriately positioned in the receptacles which are illustrated with greater particularity in FIGS. 4 and 5.

Figure 4:
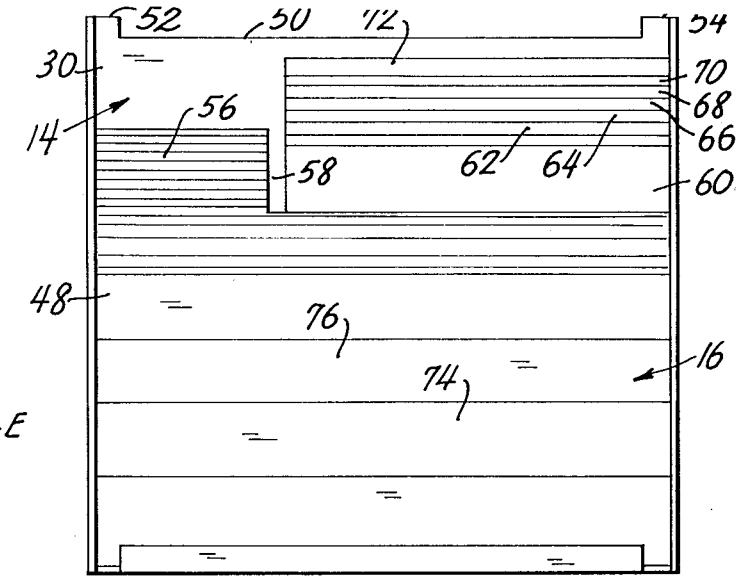
FIG. 4 is a front view of the structure as illustrated in FIG. 3.
Figure 5:
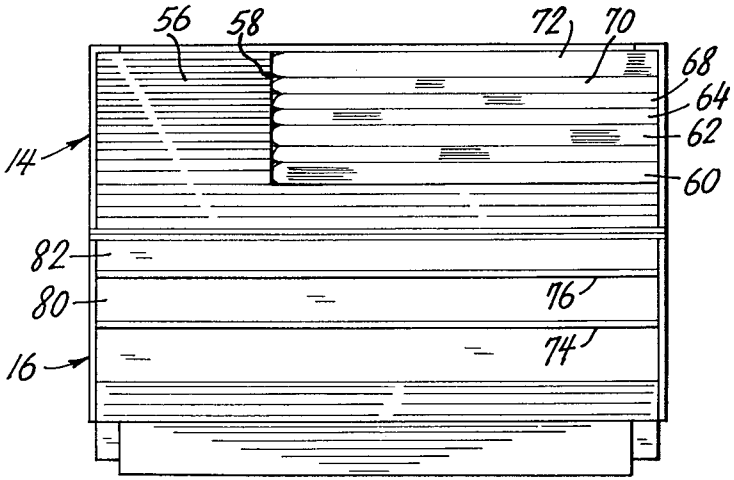
FIG. 5 is a top view of the display box as illustrated in FIGS. 3 and 4.

In FIGS. 4 and 5, sections 14 and 16 are shown in the pivotted relationship whereby the box assumes opened condition. The rear face or edge of the section 16 is indicated at 30. Therein is cut a female portion or notch 50 leaving upstanding ears 52 and 54. The section 14 is moreover provided with a cover 56 which covers or obturates the inner space of the section 14. The cover 56 is provided with an opening 58 wherein may be inserted material to be displayed. In the existing opening 58 are shown pamphlets 60, 62, 64, 66, 68, 70 and 72. These pamphlets are graduated in height and sit against the flat bottom 34 of the section 14, thereby to be readily available for selection and removal from the opening 58.

Section 16 is illustrated in FIGS. 4 and 5 as having a plurality of partitions such as indicated at 74 and 76. The cooperating face of the box, namely face 48, which rests against the face 46 of section 14 establishes a plane with respect to which partitions 74 and 76 are in parallel. The partitions 74 and 76 define compartments 80 and 82 which receive disks, pamphlets or the like or any other materials which may be suitable for display and advertising.

FIGS. 3 and 5 illustrate a male portion or foot 84 which constitutes the member by which the second section 16 engages the top of the first section 14 in the closed condition of FIG. 2. More particularly, the foot 84 engages in the slot 50 to form a closure therewith as appears in FIG. 1. As appears more particularly in FIG. 3, foot 84 which constitutes the male portion of the inter-engaging parts has a triangular configuration. It thus has a sloped surface 86 which constitutes a resting place for pamphlets or the like so that the apparatus of the invention can serve not only as a storage box and a display box, but also as a reading stand as well.

As appears in FIG. 3, the section 14 has a breadth A which is equal to the breadth B of the section 16 complete with the foot 84. This enables the section 16 to be pivoted upwardly to constitute a rectangular structure as is illustrated in FIG. 1.

The breadth A is also illustrated in FIG. 1. This breadth may be, for example, of a range of magnitude of from two to three inches or the like. Actually, any suitable size may be selected. The top portion of the section 14 has a breadth which constitutes from about $\frac{1}{4}$ to 1/5 of the total breadth A. This section is indicated at C with the face 28 having the remaining breadth which is indicated at D. Thus, the dimensions C+D equal the total breadth A of the box 10 or of section 14.

It should also be noted that the total height of the box 10 or of section 14 is indicated at E. This may be, for example, within the range of 8–16" although other dimensions are equally suitable provided that the associated materials can be displayed and stored. The height of section 16 is indicated at E/2 in FIG. 1. This is also the height of the front face of section 14 which is also indicated at E/2.

It will also be noted that the partitions 74 and 76 are of graduated height, the partition 76 being of greater height than the partition 74. It will also be noted that the rear wall 48 of the section 16 as it appears in FIGS. 4 and 5 is of greater height than the partition 76.

There will now be obvious to those skilled in the art, many modifications and variations of the construction set forth hereinabove. These modifications and variations will not depart from the scope of the invention if defined by the following claims.

What is claimed is:

1. A display box for displaying materials, said box comprising hingedly-connected first and second sections adapted for relative pivotal motion between closed and opened conditions, said sections in said closed condition coopertively defining an enclosed storage space, said sections in said opened condition respectively defining adjacent supplementary receptacles for the accommodation and display of said materials, the sections in said closed condition having edges which are in facing and abutting relation, said edges in said opened condition being in rectilinear extension of one another, said sections having co-planar top faces constituting the top of said box in said closed condition, said first section including a bottom face constituting the bottom of said box, the top face of the second section moving into co-planar relation with the bottom face of the first section in the said opened condition, said sections having in said closed ondition, co-planar front faces which in said opened condition move into fac-to-face abutting relation, said box including a rear top edge portion at which said sections include inter-engageable male and female portions, the male portion having a generally triangular cross-section.

2. A display box as claimed in claim 1 wherein said sections have co-planar top faces constituting the top of said box in said closed condition, said first section including a bottom face constituting the bottom of said box, the top face of the second section moving into co-planar relation with the bottom face of the first section in the said opened condition.

3. A display box as claimed in claim 1 wherein said sections have, in said closed condition, co-planar front faces which in said opened condition move into face-to-face abutting relation.

4. A display box as claimed in claim 1 wherein said second section defines an inner space and includes at least one interior partition parallel to the front face of the second section and dividing the inner space of the second section.

5. A display box as claimed in claim 4 wherein the second section includes a plurality of graduated partitions including the first said partition.

6. A display box as claimed in claim 1 wherein the first section defines an inner space and includes a cover partly covering said space and defining an open receptacle into which at least some of said materials can be inserted.

7. A display box as claimed in claim 6 wherein comprising pamphlets of graduated height in said receptacle.

8. A display box as claimed in claim 6 wherein said cover is sloped.

9. A display box as claimed in claim 1 comprising sleeve type cover encircling the sections in said closed condition to hold the sections in said closed condition.

10. A display box as claimed in claim 1 wherein the second section has triangular end faces and cross-section.

11. A display box as claimed in claim 1 wherein the second section has a height which is at least approximately one-half the height of the box.

* * * * *